US009704673B2

(12) United States Patent
Hirose et al.

(10) Patent No.: US 9,704,673 B2
(45) Date of Patent: Jul. 11, 2017

(54) CIRCUIT BREAKER

(71) Applicant: FUJI ELECTRIC FA COMPONENTS & SYSTEMS CO., LTD., Tokyo (JP)

(72) Inventors: Takamine Hirose, Kounosu (JP); Yoshinobu Hamada, Kounosu (JP); Yohei Hosooka, Ohtawara (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 17 days.

(21) Appl. No.: 14/869,179

(22) Filed: Sep. 29, 2015

(65) Prior Publication Data

US 2016/0020046 A1 Jan. 21, 2016

Related U.S. Application Data

(63) Continuation of application No. PCT/JP2014/001287, filed on Mar. 7, 2014.

(30) Foreign Application Priority Data

Apr. 3, 2013 (JP) ..... 2013-077942

(51) Int. Cl.
*H01H 1/64* (2006.01)
*H01H 1/66* (2006.01)
(Continued)

(52) U.S. Cl.
CPC ..... *H01H 21/08* (2013.01); *H01H 9/16* (2013.01); *H01H 21/22* (2013.01); *H01H 71/04* (2013.01);
(Continued)

(58) Field of Classification Search
CPC .. H01H 1/64; H01H 1/66; H01H 9/02; H01H 9/06; H01H 13/00; H01H 19/04;
(Continued)

(56) References Cited

U.S. PATENT DOCUMENTS 3,770,921 A * 11/1973 Wilbrecht ..... H01H 15/102 200/16 R
4,644,122 A 2/1987 Farley et al.
2006/0255891 A1* 11/2006 Porterfield ..... H01H 9/04 335/156

FOREIGN PATENT DOCUMENTS

CN 86105823 A 2/1987
CN 101908446 A 12/2010
(Continued)

OTHER PUBLICATIONS

PCT, "International Search Report for International Application No. PCT/JP2014/001287".
(Continued)

*Primary Examiner* — Anthony R. Jimenez
(74) *Attorney, Agent, or Firm* — Manabu Kanesaka

(57) ABSTRACT

A circuit breaker includes a main body case, an operating handle having a base portion and a knob portion protruding outwardly through a handle window frame opened in a cover of the main body case; a first shutter arranged between the base portion of the operating handle and the handle window frame, and disposed on the base portion, the first shutter being formed with a loose-fit hole to loosely fit the knob portion therethrough; and a second shutter disposed on the first shutter to move along with the knob portion. At ON and OFF positions of the operating handle, the first shutter extends beyond a front/rear edge of the handle window frame in a front-back direction to close the handle window
(Continued)

frame, and the second shutter extends beyond a front/rear edge of the loose-fit hole in the front-back direction to close the loose-fit hole.

3 Claims, 7 Drawing Sheets

(51) Int. Cl.

| | |
|---|---|
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |
| ***H01H 21/08*** | (2006.01) |
| ***H01H 71/04*** | (2006.01) |
| ***H01H 9/16*** | (2006.01) |
| ***H01H 21/22*** | (2006.01) |
| *H01H 9/04* | (2006.01) |

(52) U.S. Cl.
CPC ..... *H01H 9/04* (2013.01); *H01H 2071/046* (2013.01)

(58) Field of Classification Search
CPC ..... H01H 19/08; H01H 21/00; H01H 71/00; H01H 71/02; H01H 71/0214; H01H 71/0264; H01H 9/0207; H01H 9/04; H01H 9/0264; H01H 71/121; H01H 2009/02; H01H 2009/0292; H01H 2009/04; H01H 2009/048; H01H 2009/16; H01H 2013/04; H01H 2013/06; H01H 2223/00; H01H 2223/002; H01H 2223/044; H01H 21/08; H01H 21/22; H01H 9/16; H01H 71/04; H01H 2071/046
USPC ..... 200/293, 302.1, 302.3, 329, 332, 345
See application file for complete search history.

(56) References Cited

FOREIGN PATENT DOCUMENTS

| | | | |
|---|---|---|---|
| JP | 3296460 | B2 | 7/2002 |
| JP | 2003-045310 | A | 2/2003 |
| JP | 2008-186644 | A | 8/2008 |
| JP | 4253701 | B2 | 4/2009 |

OTHER PUBLICATIONS

China Patent Office, "Office Action for Chinese Patent Application No. 201480019314.4," Sep. 1, 2016.

* cited by examiner

CIRCUIT BREAKER

CROSS-REFERENCES TO RELATED APPLICATIONS

The present application is a Continuation Application of PCT International Application No. PCT/JP2014/001287 filed Mar. 7, 2014, and claiming priority from Japanese Application No. 2013-077942 filed Apr. 3, 2013, the disclosure of which is incorporated herein.

TECHNICAL FIELD

The present invention relates to a circuit breaker such as molded case circuit breakers or other circuit breakers, and more specifically a structure that prevents the entry of dust through a handle window frame formed in a main body case.

BACKGROUND ART

FIG. 7 shows a conventional circuit breaker. Reference numeral 1 represents a case made of mold resin, and reference numeral 2 represents a cover made of mold resin. Inside the case 1 are a power supply-side terminal plate 3, a second movable contact 4, a first movable contact 5, an arc-extinguishing chamber 6, a switching mechanism 7, an operating handle 8, an overcurrent tripping device 9, a load-side terminal plate 10, and the like.

The operating handle 8 is a resin-molded article that has a knob portion 8*b* provided upright at the center of a flange-shaped base portion 8*a* having an arc-shaped cross section. The base portion 8*a* is joined to the top portion of a swing-type handle lever 11, and the knob portion 8*b*, which protrudes outward through a handle window frame 2*a* opened on a cover 2, is operated manually to the ON or OFF position (see Patent Literature 1, for example).

Incidentally, the size of the base portion 8*a* that extends in a movable direction of the knob portion 8*b* can be made larger than the size of the handle window frame 2*a* in order to prevent the entry of dust into the case 1 through the handle window frame 2*a* opened in the cover 2. However, in view of the spaces for disposing the other breaker functional components, it is difficult to increase the size of the base portion 8*a* of the operating handle 8, raising the risk of enlarging the entire circuit breaker.

Based on Patent Literature 2, the applicants of the present invention have contrived a technique for reducing the size of the operating handle 8 by forming a small base portion, in which a sheet-shaped handle shutter, laid between the base portion and the handle window frame and fitted externally to the knob portion, is moved along with the knob portion to close the space between the base portion and the handle window frame.

Patent Literature 1: Japanese Patent No. 3296460

Patent Literature 2: Japanese Patent No. 4253701

DISCLOSURE OF THE INVENTION

The technique disclosed in Patent Literature 2, however, requires a large movable space for allowing the handle shutter to move along with the knob portion in the case 1, and therefore has a limitation in space for disposing the other breaker functional components.

An object of the present invention, therefore, is to provide a circuit breaker that has closing means for preventing the entry of dust by closing the space between the base portion and the handle window frame with a small movable space, so as to accomplish miniaturization of the circuit breaker.

In order to achieve the foregoing object, in a circuit breaker according to one aspect of the present invention, breaker functional components including an operating handle are installed in a main body case having a case and a cover. The operating handle has a knob portion provided upright on an upper surface of a flange-shaped base portion coupled to a top portion of a swing-type handle lever, and the knob portion protruding outward through a handle window frame opened in the cover. Between the base portion of the operating handle and the handle window frame, are formed a first shutter formed with a loose-fit hole for loosely fitting the knob portion therethrough, and disposed on the base portion, and a second shutter that moves along with the knob portion. At ON and OFF positions of the operating handle, the first shutter extends beyond a front/rear edge of the handle window frame in a front-back direction to close the handle window frame, and the second shutter extends beyond a front/rear edge of the loose-fit hole in the front-back direction to close the loose-fit hole.

The circuit breaker according to one aspect of the present invention is capable of closing the space between the base portion and the handle window frame by means of the two-stage shutter structure formed from the first shutter and the second shutter, preventing the entry of dust into the device through the handle window frame.

In the circuit breaker according to one aspect of the present invention, the loose-fit hole formed in the first shutter is an elongated hole in which a longitudinal direction thereof is a moving direction of the knob portion, and the first shutter moves when the knob portion abuts against an end portion of the loose-fit hole in the longitudinal direction.

According to the circuit breaker of the foregoing aspect of the present invention, when the operating handle is moved to the ON or OFF position, the first shutter moves at a short stroke, preventing the first shutter from wrongly interfering with other breaker functional components installed on the inside of the case main body, and consequently achieving miniaturization of the circuit breaker.

In the circuit breaker according to one aspect of the present invention, the second shutter is formed with a fitting hole for fitting a basal portion of the knob portion therethrough, and moves integrally with the knob portion.

In the circuit breaker according to one aspect of the present invention, the second shutter is disposed on the first shutter, and the first shutter is provided with a guide portion for guiding a moving direction of the second shutter.

The circuit breaker according to one aspect of the present invention enables the second shutter to move smoothly along with the knob portion.

In the circuit breaker according to one aspect of the present invention, the second shutter is a display plate for displaying ON and OFF states of the operating handle.

According to the circuit breaker of the foregoing aspect of the present invention, the display plate functions not only to indicate the operation of the circuit breaker but also to prevent the entry of dust into the device, achieving a reduction in device costs.

Not only can the circuit breaker according to the present invention prevent the entry of dust by closing the space between the base portion and the handle window frame, but also the circuit breaker can be reduced in size.

BEST MODE FOR CARRYING OUT THE INVENTION

A mode for carrying out the present invention (simply referred to "embodiment," hereinafter) is described hereinafter in detail with reference to the drawings.

Figure 1:
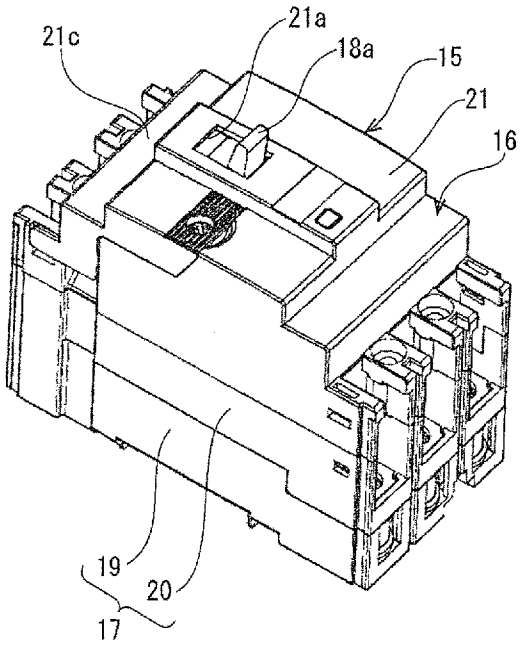
FIG. 1 is a perspective view showing the exterior of a circuit breaker according to the present invention.
Figure 2:
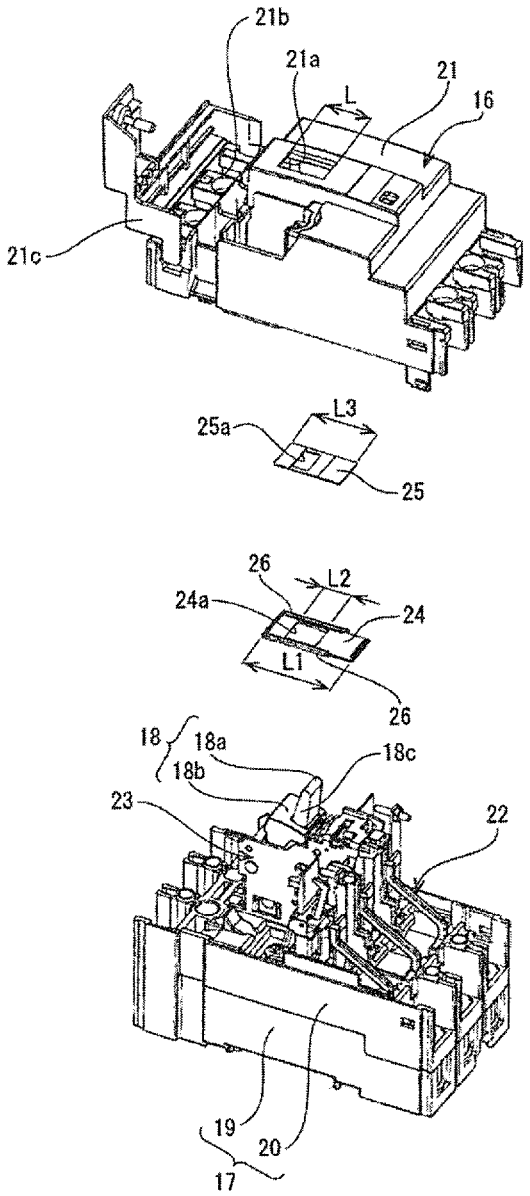
FIG. 2 is an exploded perspective view of the circuit breaker according to the present invention.

FIG. 1 is a perspective view showing the exterior of a circuit breaker 15 according to the present invention, and FIG. 2 is an exploded perspective view of the circuit breaker 15.

As shown in FIG. 1, the circuit breaker 15 according to the present embodiment has a cover 16 and a case 17, both of which are made of resin mold. A knob portion 18*a* of an operating handle 18, described hereinafter, protrudes outward from a rectangular handle window frame 21*a* that is formed in an open fashion in an upper surface of the cover 16.

The case 17 includes a lower case 19 forming the bottom of the circuit breaker 15, and a middle case 20 attached to the upper portion of the lower case 19.

The cover 16 is attached to the upper portion of the middle case 20 and includes an upper cover 21 in which the handle window frame 21*a* is formed, and an auxiliary cover 21*c* attached turnably to the upper cover 21 so as to be opened/closed. When the auxiliary cover 21*c* is opened as shown in FIG. 2, a connecting part 21*b* to which an attached switch (not shown) can be connected is formed under the cover 16.

As shown in FIG. 2, an overcurrent tripping device 22 and a switching mechanism 23 are accommodated inside the case 17, wherein the overcurrent tripping device 22 is coupled to a fixed contact (not shown) and the switching mechanism 23 is coupled to a movable contact (not shown) by a toggle link (not shown).

The operating handle 18 is coupled to the upper portion of the switching mechanism 23.

The operating handle 18 is a resin-molded article having a flange-shaped base portion 18*b* with an arc-shaped cross section that is joined to the top portion of a swing-type handle lever (23*a*) and the knob portion 18*a* that is provided upright at the center of the base portion 18*b*. When the cover 16 is attached from above, the knob portion 18*a* protrudes outward through the handle window frame 21*a*, so the knob portion 18*a* can be operated manually to the ON and OFF positions in the longitudinal direction of the handle window frame 21*a*.

In the circuit breaker 15 of the present embodiment, prior to attaching the cover 16 by allowing the knob portion 18*a* of the operating handle 18 to pass through the handle window frame 21*a*, a handle shutter 24 that is loosely fitted to the knob portion 18*a* is disposed to abut against the base portion 18*b*, and a display plate 25 is disposed on this handle shutter 24.

The handle shutter 24 is a flexible, flat plastic plate in a rectangular shape. The longitudinal size L1 of the handle shutter 24 is greater than the longitudinal opening size L of the handle window frame 21*a*. The lateral size of the handle shutter 24 is also greater than the lateral opening size of the handle window frame 21*a*.

A loose-fit hole 24*a* to which the knob portion 18*a* is loosely fitted is formed in the handle shutter 24. This loose-fit hole 24*a* is a rectangular hole having the direction of movement of the knob portion 18*a* as its longitudinal direction. The lateral size of the loose-fit hole 24*a* is equivalent to the widthwise size of the knob portion 18*a*. The longitudinal size L2 is set to be greater than the thickness of a basal portion of the knob portion 18*a* (the thickness of the portion indicated by reference numeral 18*c* in FIG. 2).

A pair of convex guide rails 26 is formed on either lateral rim portion of the handle shutter 24 along the longitudinal direction.

This handle shutter 24 is disposed on the base portion 18*b*, with the pair of guide rails 26 facing upward and the knob portion 18*a* being fitted loosely to the loose-fit hole 24*a*.

On the other hand, the display plate 25, too, is a flexible, flat plastic plate in a rectangular shape. The longitudinal size L3 of the display plate 25 is set to be greater than the longitudinal size L2 of the loose-fit hole 24*a* of the handle shutter 24. The lateral size of the display plate 25 is set to be equivalent to the distance between the pair of guide rails 26 formed in the handle shutter 24.

A fitting hole 25*a* that has the same cross-sectional shape as the basal portion 18*c* of the knob portion 18*a* and is opened in a quadrangular shape is formed in this display plate 25.

The display plate 25 is disposed on the upper portion of the handle shutter 24, with lateral side portions of the display plate 25 being slidably engaged with the pair of guide rails 26 of the handle shutter 24 and the basal portion 18*c* of the knob portion 18*a* being engaged with the fitting hole 25*a*.

The main body case according to the present invention corresponds to the cover 16 and case 17, the first shutter according to the present invention corresponds to the handle shutter 24, the second shutter according to the present invention corresponds to the display plate 25, and the guide portion according to the present invention corresponds to the pair of guide rails 26.

Figure 3:
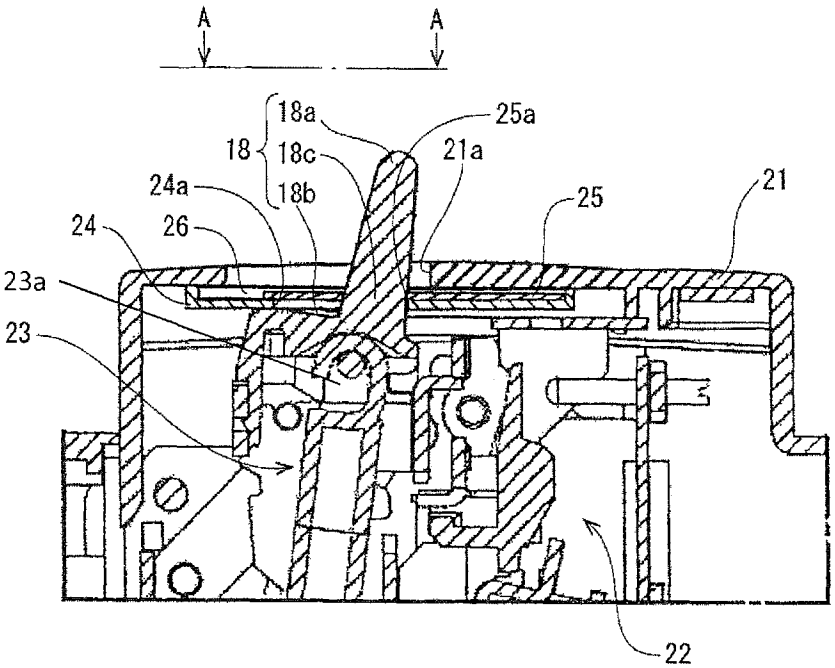
FIG. 3 is a cross-sectional view of substantial parts, showing a state in which an operating handle of the circuit breaker according to the present invention is moved to the OFF position.
Figure 4:
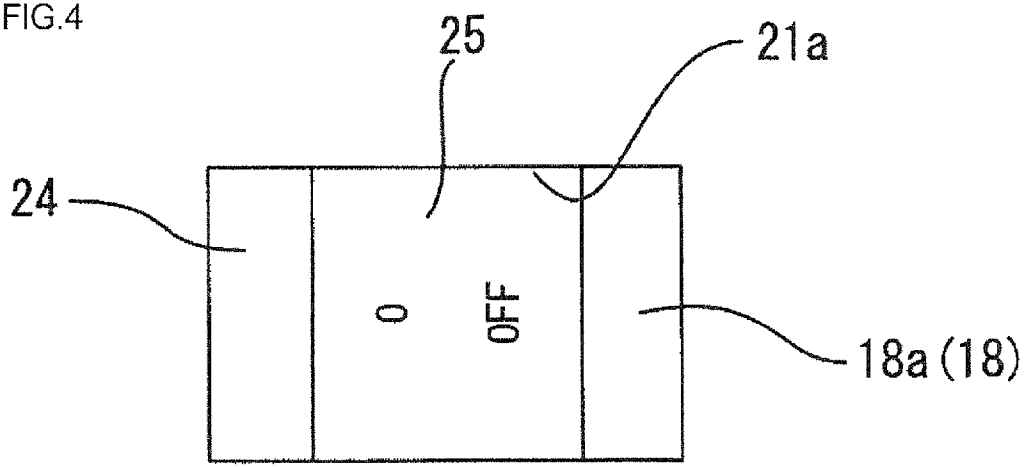
FIG. 4 shows a portion of the circuit breaker according to the present invention as viewed in a direction of the arrow from the line A-A of FIG. 3.
Figure 5:
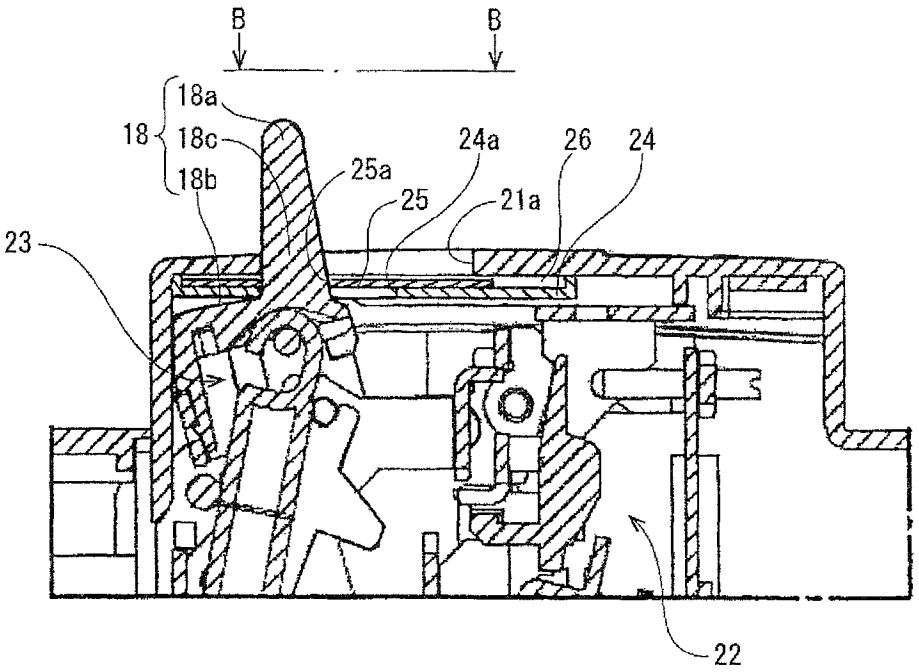
FIG. 5 is a cross-sectional view of the substantial parts, showing a state in which the operating handle of the circuit breaker according to the present invention is moved to the ON position.
Figure 6:
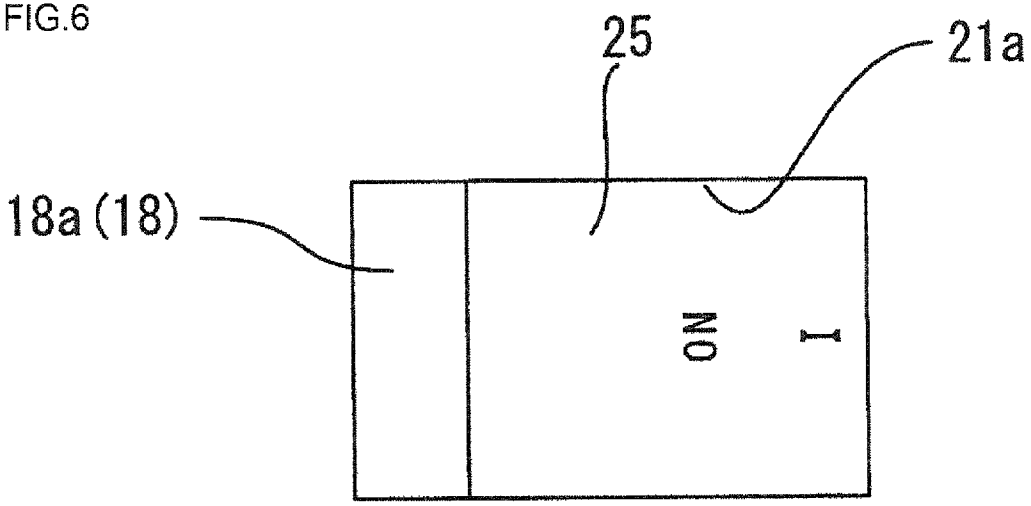
FIG. 6 shows a portion of the circuit breaker according to the present invention as viewed in a direction of the arrow from the line B-B of FIG. 5.
Figure 7:
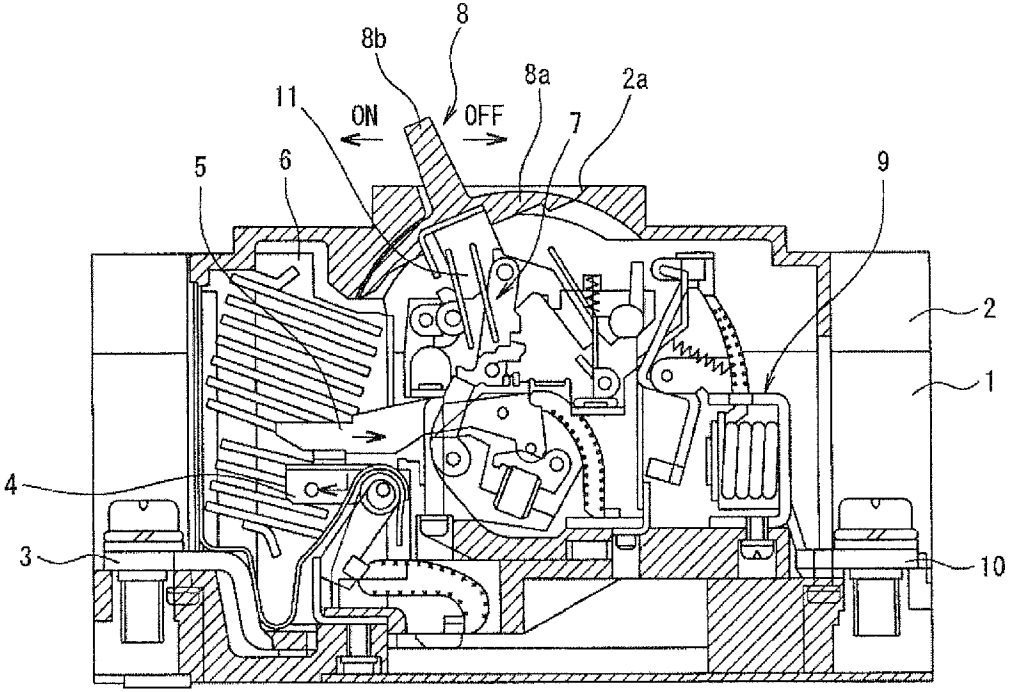
FIG. 7 is a cross-sectional view showing a conventional circuit breaker from a side.

Next are described an operational state shown in FIGS. 3 and 4 in which the knob portion 18*a* of the operating handle 18 is moved to the OFF position in the circuit breaker 15 having the handle shutter 24 and display plate 25 between the base portion 18*b* of the operating handle 18 and the handle window frame 21*a* of the cover 16 (the upper cover 21), and an operational state shown in FIGS. 5 and 6 in which the knob portion 18*a* is moved to the ON position.

In order to move the knob portion 18*a* of the operating handle 18 to the OFF position, the knob portion 18*a* that is loosely fitted to the loose-fit hole 24*a* of the handle shutter 24 is moved to the right-hand side of FIG. 3, as shown in FIG. 3. In so doing, the knob portion 18*a* moves toward one of the end portions of the loose-fit hole 24*a* of the handle shutter 24 (the right end portion in FIG. 3) in the longitudinal direction without engaging the edge of the loose-fit hole 24*a*. Once the basal portion 18*c* of the knob portion 18*a* abuts against one of the end portions of the loose-fit hole 24*a* in the longitudinal direction, the handle shutter 24 moves to the right at a short stroke. Then, once the knob portion 18*a* is moved to the OFF position completely, the handle shutter 24 that moves to the right at a short stroke stops while covering the handle window frame 21*a* from below. Note that this state corresponds to the state described in the present invention in which the first shutter extends from a front/rear end of the handle window frame in a front-back direction to close the handle window frame.

In such a state, the region of the loose-fit hole 24*a* of the handle shutter 24 other than the region through which the knob portion 18*a* passes is opened, but this opened region is covered by the display plate 25 that moves integrally with the knob portion 18*a*, with the basal portion 18*c* of the knob portion 18*a* being engaged with the fitting hole 25*a*. Therefore, the space between the base portion 18*b* and the handle window frame 21*a* is closed. Note that this state corresponds to the state described in the present invention in which the second shutter extends beyond a front/rear end of the loose-fit hole in the front-back direction to close the loose-fit hole.

Subsequently, as shown in FIG. 4, letters "O" and "OFF" written on the display plate 25, indicating that the operating handle 18 is operated to the OFF position, are displayed from the handle window frame 21*a* to the outside.

Moreover, in order to move the knob portion 18*a* of the operating handle 18 to the ON position, the knob portion 18*a* is moved to the left-hand side of FIG. 5, as shown in FIG. 5. In so doing, the knob portion 18*a* moves toward the other end portion of the loose-fit hole 24*a* of the handle shutter 24 (the left end portion in FIG. 5) in the longitudinal direction without engaging the edge of the loose-fit hole 24*a*. Once the basal portion 18*c* of the knob portion 18*a* abuts against this other end portion of the loose-fit hole 24*a* in the longitudinal direction, the handle shutter 24 moves to the left at a short stroke. Then, once the knob portion 18*a* is moved to the ON position completely, the handle shutter 24 that moves to the left at a short stroke stops while covering the handle window frame 21*a* from below.

Even after moving the knob portion 18*a* to the ON position, the region of the loose-fit hole 24*a* of the handle shutter 24 other than the region through which the knob portion 18*a* passes is opened, but this opened region is covered by the display plate 25 that moves integrally with the knob portion 18*a*. Therefore, the space between the base portion 18*b* and the handle window frame 21*a* is closed.

Subsequently, as shown in FIG. 6, letters "I" and "ON" written on the display plate 25, indicating that the operating handle 18 is operated to the ON position, are displayed from the handle window frame 21*a* to the outside.

The effects of the circuit breaker 15 of the present embodiment are described next.

The circuit breaker 15 of the present embodiment has the handle shutter 24 that forms the loose-fit hole 24*a* for loosely fitting the knob portion 18*a* of the operating handle 18 and is capable of covering the handle window frame 21*a*, and the display plate 25 that moves integrally with the knob portion 18*a* to close the region of the loose-fit hole 24*a* of the handle shutter other than the region through which the knob portion 18*a* passes, wherein the space between the base portion 18*b* and the handle window frame 21*a* can be closed with the two-stage shutter structure formed from the handle shutter 24 and the display plate 25, preventing the entry of dust into the device through the handle window frame 21*a*.

Furthermore, due to the loose-fit hole 24*a* that is formed for loosely fitting the knob portion 18*a* of the operating handle 18, the handle shutter 24 moves at a short stroke (small movable space) when the operating handle 18 is moved to the ON or OFF position, preventing the handle shutter 24 from wrongly interfering with other breaker functional components installed on the inside of the cover 16 and case 17, and consequently achieving miniaturization of the circuit breaker.

Moreover, the handle shutter 24 has the pair of guide rails for slidably supporting the lateral rim portions of the display plate 25, thereby enabling the display plate 25 to move smoothly along with the knob portion 18*a*.

In addition, the display plate 25 functions not only to primarily indicate the operation of the circuit breaker 15 but also to prevent the entry of dust into the device, achieving a reduction in device costs.

INDUSTRIAL APPLICABILITY

As described above, the circuit breaker according to the present invention has the closing means for preventing the entry of dust by closing the space between the base portion and the handle window frame with a small movable space, and is therefore useful in miniaturization thereof.

EXPLANATION OF REFERENCE NUMERALS

15 . . . Circuit breaker, 16 . . . Cover, 17 . . . Case, 18 . . . Operating handle, 18*a* . . . Knob portion, 18*b* . . . Base portion, 18*c* . . . Basal portion, 19 . . . Lower case, 20 . . . Middle case, 21 . . . Upper cover, 21*a* . . . Handle window frame, 21*b* . . . Connecting part, 21*c* . . . Auxiliary cover, 22 . . . Overcurrent tripping device, 23 . . . Switching mechanism, 24 . . . Handle shutter, 24*a* . . . Loose-fit hole, 25 . . . Display plate, 25*a* . . . Fitting hole, 26 . . . Guide rail

What is claimed is:

1. A circuit breaker, comprising:

a main body case including a case and a cover having a handle window frame;

a breaker functional component including an operating handle installed in the main body case, the operating handle having a flange-shaped base portion coupled to a top portion of a swing-type handle lever, and a knob portion provided upright on an upper surface of the base portion to protrude outwardly through the handle window frame opened in the cover;

a first shutter arranged between the base portion of the operating handle and the handle window frame, and disposed on the base portion, the first shutter being formed with a loose-fit hole to loosely fit the knob portion therethrough; and a second shutter arranged between the base portion of the operating handle and the handle window frame, and disposed on the first shutter to move along with the knob portion, wherein the second shutter is formed with a fitting hole to fit a basal portion of the knob portion, and move integrally with the knob portion, at ON and OFF positions of the operating handle, the first shutter extends beyond a front/rear edge of the handle window frame in a front-back direction to close the handle window frame, and the second shutter extends beyond a front/rear edge of the loose-fit hole in the front-back direction to close the loose-fit hole, and wherein the loose-fit hole formed in the first shutter is an elongated hole in which a longitudinal direction thereof is a moving direction of the knob portion, and the first shutter moves a distance when the knob portion abuts an end portion of the loose-fit hole in the longitudinal direction.

2. A circuit breaker, comprising:

a main body case including a case and a cover having a handle window frame;

a breaker functional component including an operating handle installed in the main body case, the operating handle having a flange-shaped base portion coupled to a top portion of a swing-type handle lever, and a knob portion provided upright on an upper surface of the base portion to protrude outwardly through the handle window frame opened in the cover;

a first shutter arranged between the base portion of the operating handle and the handle window frame, and disposed on the base portion, the first shutter being formed with a loose-fit hole to loosely fit the knob portion therethrough; and a second shutter arranged between the base portion of the operating handle and the handle window frame, and disposed on the first shutter to move along with the knob portion, wherein at ON and OFF positions of the operating handle, the first shutter extends beyond a front/rear edge of the handle window frame in a front-back direction to close the handle window frame, and the second shutter extends beyond a front/rear edge of the loose-fit hole in the front-back direction to close the loose-fit hole, and the first shutter includes a guide portion for guiding a moving direction of the second shutter.

3. The circuit breaker according to claim 1, wherein the second shutter is a display plate for displaying ON and OFF states of the operating handle.

* * * * *